US008770963B2

(12) United States Patent
Kuriki

(10) Patent No.: US 8,770,963 B2
(45) Date of Patent: Jul. 8, 2014

(54) SPLASH PAN OF A POTTERY WHEEL AND POTTERY WHEEL PROVIDED WITH THE SAME

(75) Inventor: Motoki Kuriki, Kyoto (JP)

(73) Assignee: Nidec-Shimpo Corporation, Kyoto (JP)

( * ) Notice: Subject to any disclaimer, the term of this patent is extended or adjusted under 35 U.S.C. 154(b) by 483 days.

(21) Appl. No.: 13/071,708

(22) Filed: Mar. 25, 2011

(65) Prior Publication Data

US 2011/0236515 A1 Sep. 29, 2011

(30) Foreign Application Priority Data

Mar. 27, 2010 (JP) ..... 2010-073938

(51) Int. Cl.
*B28B 1/02* (2006.01)

(52) U.S. Cl.
USPC ..... 425/263; 425/267; 425/348 S; 425/451.9; 425/459; 425/DIG. 120

(58) Field of Classification Search
USPC ..... 425/263, 266, 267, 348 S, 451.9, 459, 425/DIG. 120
See application file for complete search history.

(56) References Cited

U.S. PATENT DOCUMENTS

| | | | | |
|---|---|---|---|---|
| 1,191,485 | A * | 7/1916 | Tompkins | 425/348 S |
| 3,849,054 | A * | 11/1974 | Jordache | 425/459 |
| 2004/0142061 | A1 | 7/2004 | Oakes | |

FOREIGN PATENT DOCUMENTS

| | | | |
|---|---|---|---|
| JP | 58-001515 | U | 1/1983 |
| JP | 2005-74801 | A | 3/2005 |

* cited by examiner

*Primary Examiner* — Joseph S Del Sole
*Assistant Examiner* — Thukhanh Nguyen
(74) *Attorney, Agent, or Firm* — Keating & Bennett, LLP

(57) ABSTRACT

A splash pan of a pottery wheel arranged to cover bottom and side areas of a turntable, includes a plurality of split dish members split in a circumferential direction and provided with a clay-storing concave portion, the split dish members being separably connectable to each other through substantially horizontal movement thereof. The split dish members are two in number and include a first split dish member having boss portions formed on an outer surface thereof and a second split dish member having engagement portions engageable with the boss portions. The engagement portions are formed on an outer surface of the second split dish member in radial positions corresponding to the boss portions and opened toward the boss portions. The engagement portions of the second split dish member are elastically deformable when engaging with the boss portions of the first split dish member.

15 Claims, 9 Drawing Sheets

SPLASH PAN OF A POTTERY WHEEL AND POTTERY WHEEL PROVIDED WITH THE SAME

BACKGROUND OF THE INVENTION

1. Field of the Invention

The present invention relates to a splash pan of a pottery wheel and a pottery wheel provided with the same and, more specifically, to a splash pan arranged to cover the bottom and side areas of a turntable of a pottery wheel and a pottery wheel provided with the splash pan.

2. Description of the Related Art

Conventionally, there is known, e.g., a pottery wheel including a splash pan arranged to cover the bottom and side areas of a turntable of the pottery wheel. The splash pan includes a plurality of split dish members split in a circumferential direction and provided with a concave portion for storage of clay. The split dish members can be separably connected to each other by moving them in a horizontal direction. The split dish members include two pieces, namely a first split dish member having boss portions formed within the concave portion and a second split dish member having engagement recesses formed within the concave portion in radial positions corresponding to the boss portions. The engagement recesses are opened toward the boss portions and engageable with the boss portions (see, e.g., Japanese Patent Application Publication No. 2005-74801).

Since the conventional pottery wheel is of the type in which the boss portions (of the first split dish member) and the engagement recesses (of the second split dish member) provided within the concave portion for storage of clay are engaged with each other, the boss portions and the engagement recesses are worn by clay or other causes. This reduces the coupling force and broadens the gap between the joint areas of the split dish members. Consequently, it is sometimes the case that clay or water collected within the concave portion is leaked through the joint areas of the first and second split dish members, thereby making the support base or the lathe body dirty.

SUMMARY OF THE INVENTION

In view of the above, the present invention provides a splash pan of a pottery wheel capable of preventing clay or water from leaking through the joint areas of split dish members in long use and a pottery wheel provided with the splash pan.

In accordance with a first aspect of the present invention, there is provided a splash pan of a pottery wheel arranged to cover bottom and side areas of a turntable, including: a plurality of split dish members split in a circumferential direction and provided with a clay-storing concave portion, the split dish members being separably connectable to each other through substantially horizontal movement thereof. The split dish members are two in number and include a first split dish member having boss portions formed on an outer surface thereof and a second split dish member having engagement portions engageable with the boss portions, the engagement portions being formed on an outer surface of the second split dish member in radial positions corresponding to the boss portions and opened toward the boss portions, the engagement portions of the second split dish member being elastically deformable when engaging with the boss portions of the first split dish member.

With such configuration, the split dish members are arranged to cover the bottom and side areas of the turntable when they are connected to each other. Therefore, the splash pan can receive clay or water scattering outwards or dropping during rotation of the turntable. The split dish members can be separated from each other and detached from the lathe body for a cleaning purpose and can be reconnected and attached to the lathe body. In the splash pan, the split dish members can be separated and connected by moving them in a horizontal direction. Therefore, there is no likelihood that clay or water collected in the concave portion is spilt. More specifically, the first and second split dish members are connected to each other as the engagement portions engage with the boss portions through the horizontal movement of the split dish members. When in a connected state, the first and second split dish members are separated from each other as the engagement portions move away from the boss portions through the horizontal movement of the split dish members. In this manner, the separation and connection of the split dish members can be performed with ease through the horizontal movement thereof.

In case where a first split dish member having boss portions formed on an inner surface thereof is connected to a second split dish member having engagement portions formed on an inner surface thereof, the coupling portions (the boss portions and the engagement portions) may be worn by clay or other materials and may have a reduced coupling force. Consequently, the gap between the joint areas of the split dish members may grow wide and clay or water may sometimes leak through the gap to the outside of the splash pan. In the invention noted above, however, the boss portions on the outer surface of the first split dish member engage with the engagement portions on the outer surface of the second split dish member. Therefore, clay or water is hard to leak through the joint areas of the first and second split dish members to the outside of the splash pan. Moreover, the boss portions of the first split dish member and the engagement portions of the second split dish member engage with each other through the elastic deformation of the engagement portions. Thanks to this feature, it is possible to reduce temporal wear (i.e., wear taking place over time) of the boss portions and the engagement portions, thereby preventing the coupling of the first and second split dish members from being loosened. There is no possibility that the gap between the joint areas of the first and second split dish members grows wide. This makes it difficult for clay or water to leak through the joint areas of the first and second split dish members to the outside of the splash pan.

In accordance with a second aspect of the present invention, there is provided a splash pan of a pottery wheel arranged to cover bottom and side areas of a turntable, including: a plurality of split dish members split in a circumferential direction and provided with a clay-storing concave portion, the split dish members being separably connectable to each other through substantially horizontal movement thereof. The split dish members are even in number and include first split dish members each having boss portions formed on an outer surface thereof and second split dish members each having engagement portions engageable with the boss portions, the engagement portions being formed on an outer surface of each of the second split dish members in radial positions corresponding to the boss portions and opened toward the boss portions, the first split dish members being equal in number to the second split dish members, the engagement portions of each of the second split dish members being elastically deformable when engaging with the boss portions of each of the first split dish members.

With such configuration, the split dish members are arranged to cover the bottom and side areas of the turntable when they are connected to each other. Therefore, the splash pan can receive clay or water scattering outwards or dropping during rotation of the turntable. The split dish members can be separated from each other and detached from the lathe body for a cleaning purpose and can be reconnected and attached to the lathe body. In the splash pan, the split dish members can be separated and connected by moving them in a horizontal direction. Therefore, there is no likelihood that clay or water collected in the concave portion is spilt. More specifically, the first and second split dish members are connected to each other as the engagement portions engage with the boss portions through the horizontal movement of the split dish members. From the connected state, the first and second split dish members are separated from each other as the engagement portions move away from the boss portions through the horizontal movement of the split dish members. In this manner, the separation and connection of the split dish members can be performed with ease through the horizontal movement thereof.

In case where first split dish members having boss portions formed on an inner surface thereof are connected to second split dish members having engagement portions formed on an inner surface thereof, the coupling portions (the boss portions and the engagement portions) may be worn by clay or other materials and may have a reduced coupling force. Consequently, the gap between the joint areas of the split dish members may grow wide and clay or water may sometimes leak through the gap to the outside of the splash pan. In the invention noted above, however, the boss portions on the outer surface of the first split dish members engage with the engagement portions on the outer surface of the second split dish members. Therefore, clay or water is hard to leak through the joint areas of the first and second split dish members to the outside of the splash pan. Moreover, the boss portions of the first split dish members and the engagement portions of the second split dish members engage with each other through the elastic deformation of the engagement portions. Thanks to this feature, it is possible to reduce temporal wear of the boss portions and the engagement portions, thereby preventing the coupling of the first and second split dish members from being loosened. There is no possibility that the gap between the joint areas of the first and second split dish members grows wide. This makes it difficult for clay or water to leak through the joint areas of the first and second split dish members to the outside of the splash pan.

In accordance with a third aspect of the present invention, there is provided a splash pan of a pottery wheel arranged to cover bottom and side areas of a turntable, including: a plurality of split dish members split in a circumferential direction and provided with a clay-storing concave portion, the split dish members being separably connectable to each other through horizontal movement thereof. Each of the split dish members includes a boss portion formed on an outer surface of one end thereof and an engagement portion engageable with the boss portion formed on an outer surface of the other end thereof, the engagement portions being elastically deformable when engaging with the boss portions.

With such configuration, it is possible to provide the same advantageous effects as available in the first and second aspects of the present invention.

The boss portions and the engagement portions may be provided in circumferential end sections of bottom surfaces of the split dish members, the boss portions extending downwards.

With such configuration, it is possible to easily perform the separation and connection of the split dish members and to stably couple the split dish members together.

The boss portions may have a cylindrical columnar shape, and the engagement portions may be engageable with the boss portions while gripping circumferential surfaces of the boss portions at left and right sides thereof.

With such configuration, it is possible to securely couple the boss portions and the engagement portions together and to smoothly and easily separate the boss portions and the engagement portions by holding the opposite ends of the split dish members.

The split dish member having the boss portions may include overlapping portions overlapping with an upper surface of the split dish member having the engagement portions when the boss portions engage with the engagement portions, the boss portions being formed in the overlapping portions.

With such configuration, the joint areas of the split dish members are covered with the overlapping portions. Therefore, clay or water is hard to leak from the joint areas of the split dish members to the outside of the splash pan.

In accordance with a fourth aspect of the present invention, there is provided a pottery wheel, including: a turntable; a motor arranged to rotationally drive the turntable;

a support base arranged to support the motor; and the splash pan of any one of the first to third aspects attached to the support base.

With such configuration, it is possible to provide a pottery wheel that can enjoy the advantageous effects offered by the splash pan described above.

According to the present invention, the boss portions on the outer surface of one of the split dish members engage with the elastic engagement portions on the outer surface of the other split dish member. This makes it possible to prevent clay or water from leaking through the joint areas of the split dish members in long use.

BRIEF DESCRIPTION OF THE DRAWINGS

The objects and features of the present invention will become apparent from the following description of embodiments, given in conjunction with the accompanying drawings, in which.

DETAILED DESCRIPTION OF THE INVENTION (Overall Configuration of Pottery Wheel)

A pottery wheel according to one preferred embodiment of the present invention will be first described with reference to the accompanying drawings which form a part hereof. In the following description, the up and down direction in FIG. 1 will be defined as an up-down direction and the left and right direction in FIG. 2A will be defined as a left-right direction.

Figure 1:
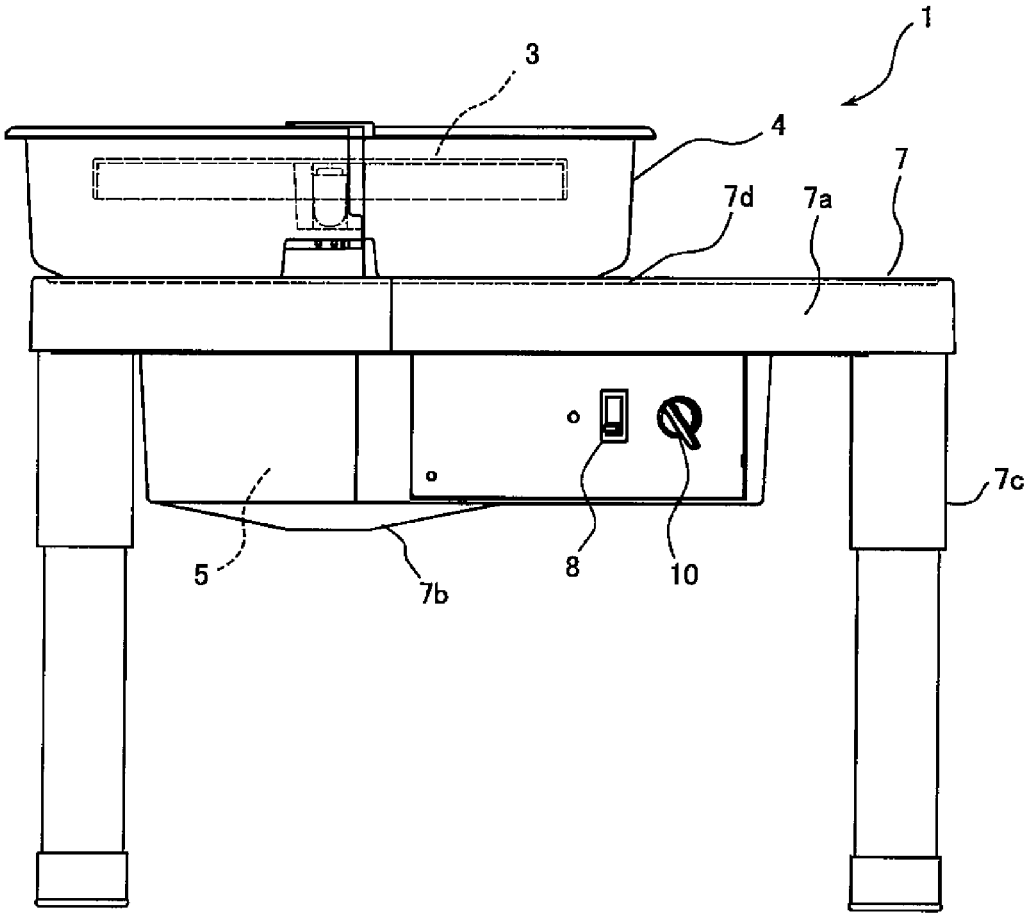
FIG. 1 is a side view showing a pottery wheel according to one preferred embodiment of the present invention.

Referring to FIG. 1, the pottery wheel 1 preferably includes a turntable 3, a motor 5, a support base 7 and a splash pan 4.

The turntable 3 is a flat member and is designed to allow a user to perform works on the upper surface side thereof. In the present preferred embodiment, the turntable 3 is directly mounted to the rotating shaft (not shown) of the motor 5.

The motor 5 is arranged to rotationally drive the turntable 3. In the present preferred embodiment, a direct drive motor, more preferably a direct current brushless motor is used as the motor 5. As will be described later, the motor 5 is supported in the housing portion 7*b* of a support base 7 and is arranged to support the turntable 3 at the upper side thereof.

The support base 7 is arranged to horizontally support the turntable 3 (including the motor 5) and preferably includes a top panel portion 7*a*, the housing portion 7*b* and leg portions 7*c*. The top panel portion 7*a* includes an upper surface 7*d* formed into a planar shape. The housing portion 7*b* is arranged on the lower surface of the top panel portion 7*a* to enclose the motor 5, a control unit (not shown) and other components therein. A power switch 8 and a forward/reverse rotation knob 10 are provided on the side surface of the housing portion 7*b*. The leg portions 7*c* are attached to the top panel portion 7*a* to extend downwards from three points on the lower surface of the top panel portion 7*a*. The splash pan 4 is attached to the upper surface 7*d* of the top panel portion 7*a*.

(Splash Pan)

Next, description will be made on the splash pan of the present pottery wheel.

The splash pan 4 is arranged to receive clay or water scattering or dropping from the upper surface of the turntable 3. The splash pan 4 is a dish-shaped member arranged to cover the bottom and side areas of the turntable 3. The splash pan 4 preferably includes a first split dish member 41 and a second split dish member 51.

(First Split Dish Member)

Figure 2A:
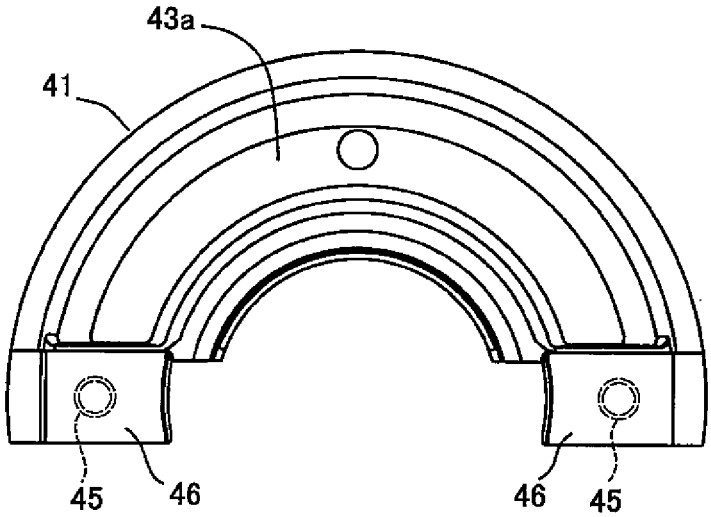
FIGS. 2A, 2B and 2C are top, bottom and side views showing a first split dish member employed in the pottery wheel.
Figure 2B:
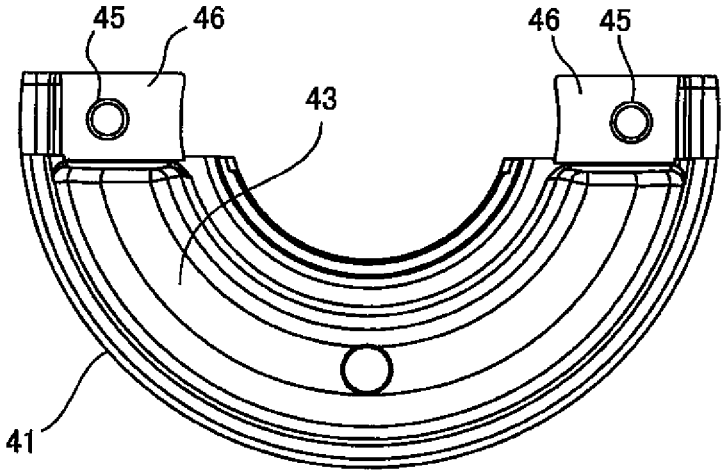
Figure 2C:
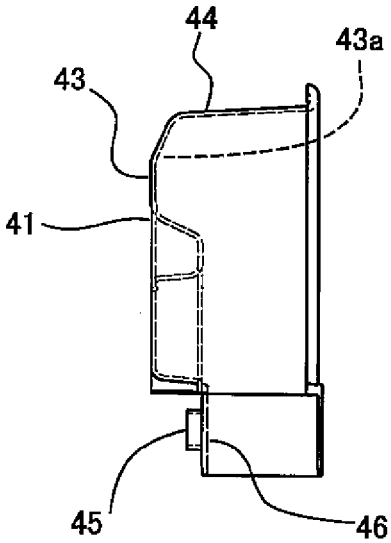

As shown in FIGS. 2A, 2B and 2C, the first split dish member 41 preferably includes a bottom portion 43 and a wall portion 44 extending upwards from the outer periphery of the bottom portion 43. The bottom portion 43 preferably includes a clay-storing concave portion 43*a* extending in a circumferential direction. The inner periphery portion and the circumferential opposite end portions of the clay-storing concave portion 43*a* are formed to protrude upwards to prevent leakage of clay or water. The first split dish member 41 preferably includes boss portions 45 formed in the circumferential opposite end portions of the outer surface (rear surface) of the bottom portion 43 and used to connect the first split dish member 41 to the second split dish member 51. More specifically, the boss portions 45 are provided on the outer surfaces (rear surfaces) of overlapping portions 46 of the first split dish member 41. The overlapping portions 46 are provided in the circumferential opposite end portions of the first split dish member 41. When the first and second split dish members 41 and 51 are connected to each other, the overlapping portions 46 overlap with the upper surface of the second split dish member 51. The boss portions 45 extend downwards and have a cylindrical shape.

(Second Split Dish Member)

Figure 3A:
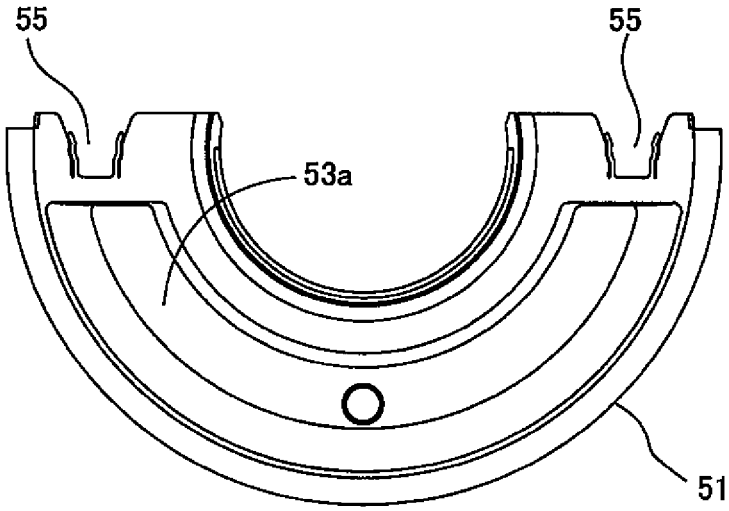
FIGS. 3A, 3B and 3C are top, bottom and side views showing a second split dish member employed in the pottery wheel.
Figure 3B:
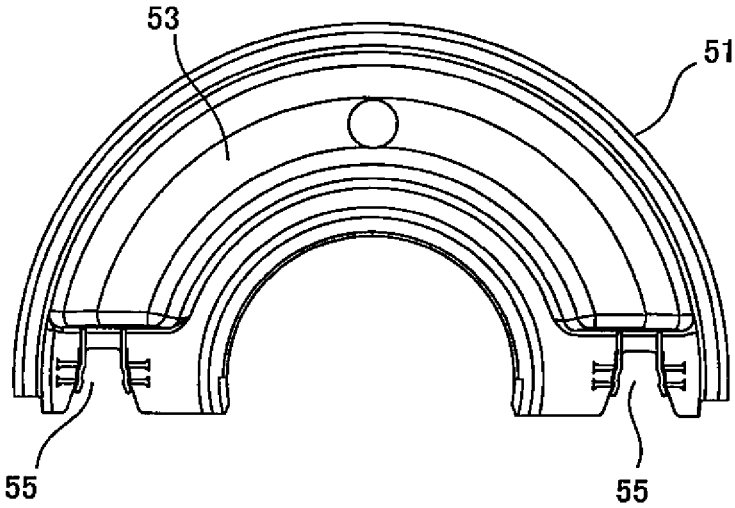
Figure 3C:
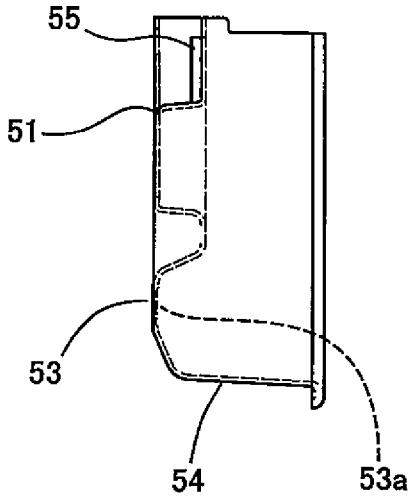

The second split dish member 51 has substantially the same configuration as that of the first split dish member 41. As shown in FIGS. 3A, 3B and 3C, the second split dish member 51 preferably includes a bottom surface portion 53 and a wall portion 54. The bottom surface portion 53 is preferably provided with a clay-storing concave portion 53*a*. The second split dish member 51 preferably includes engagement portions 55 formed in the circumferential opposite end portions of the outer surface (rear surface) of the bottom surface portion 53 and arranged to engage with the boss portions 45 of the first split dish member 41. The engagement portions 55 are formed on the outer surface (rear surface) of the second split dish member 51 in the radial positions corresponding to the boss portions 45 so that they can be opened toward the boss portions 45 of the first split dish member 41. The engagement portions 55 have a shape capable of gripping the boss portions 45 at the left and right sides thereof when the first and second split dish members 41 and 51 are connected to each other. The sections of the engagement portions 55 making contact with the boss portions 45 have a shape conforming to the circumferential surfaces of the boss portions 45. The engagement portions 55 are made of, e.g., an ABS resin, and are elastically deformed when they engage with the respective boss portions 45 as will be set forth later.

Next, description will be made on the engaging and disengaging operations of the boss portions 45 of the first split dish member 41 and the engagement portions 55 of the second split dish member 51.

When a user operates the pottery wheel 1, the power switch 8 is turned on and the operation pedal (not shown) connected to the housing portion 7*b* is pressed by a foot. Thus, the motor 5 is operated to rotationally drive the turntable 3. This makes it possible to perform pottery works on the turntable 3 using clay and water. In the pottery wheel 1, clay or water scattering outwards and dropping from the turntable 3 is received by the splash pan 4 and is collected in the clay-storing concave portion 43*a* or 53*a*. By splitting and separating the splash pan 4, it becomes possible to dump the clay or other materials collected in the clay-storing concave portion 43*a* and to wash the first and second split dish members 41 and 51.

Figure 4A:
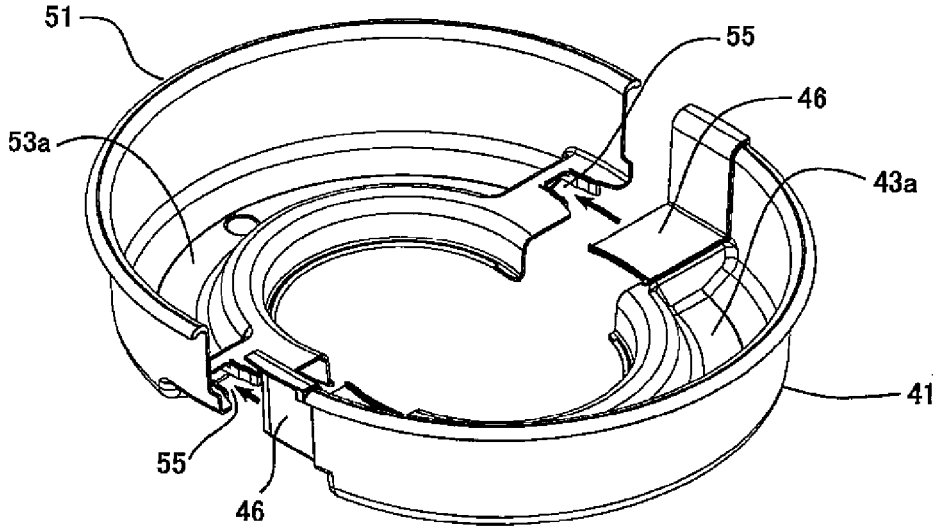
FIGS. 4A, 4B and 4C are top perspective, bottom perspective and partially enlarged views showing the first and second split dish members kept disengaged from each other.
Figure 4B:
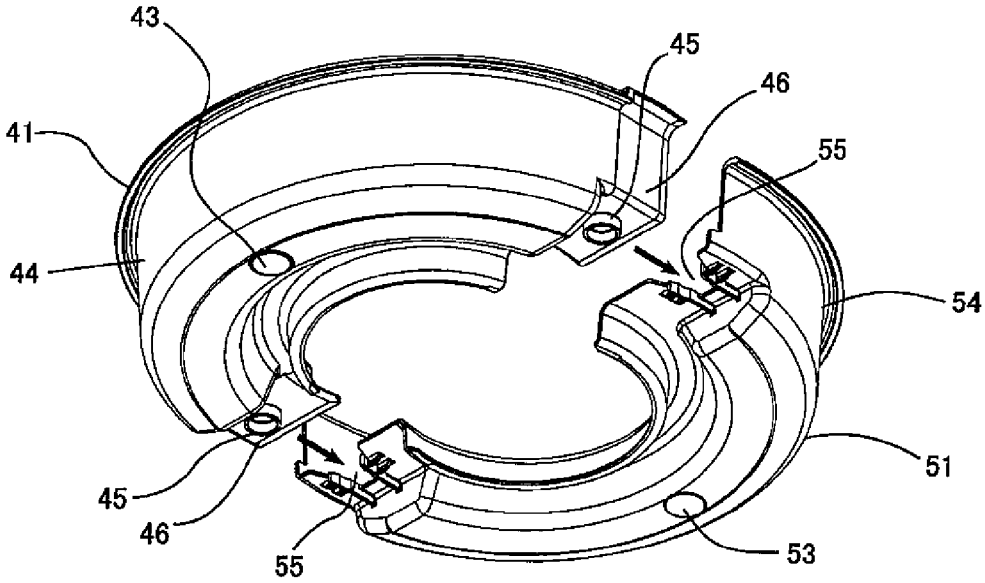
Figure 4C:
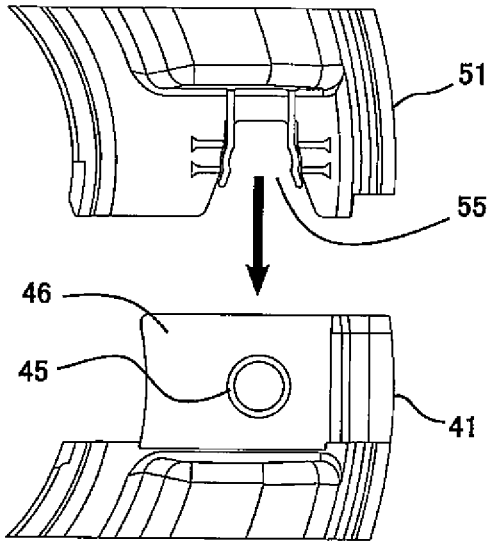

In order to separate the first and second split dish members 41 and 51, they are horizontally moved away from each other on the support base 7 as shown in FIGS. 4A, 4B and 4C. This causes the engagement portions 55 to disengage from the boss portions 45, which makes it possible to split the splash pan 4 into two pieces and to remove it from the support base 7. In this manner, a user can easily separate the first and second split dish members 41 and 51 without having to manipulate the engagement portions 55.

Figure 5A:
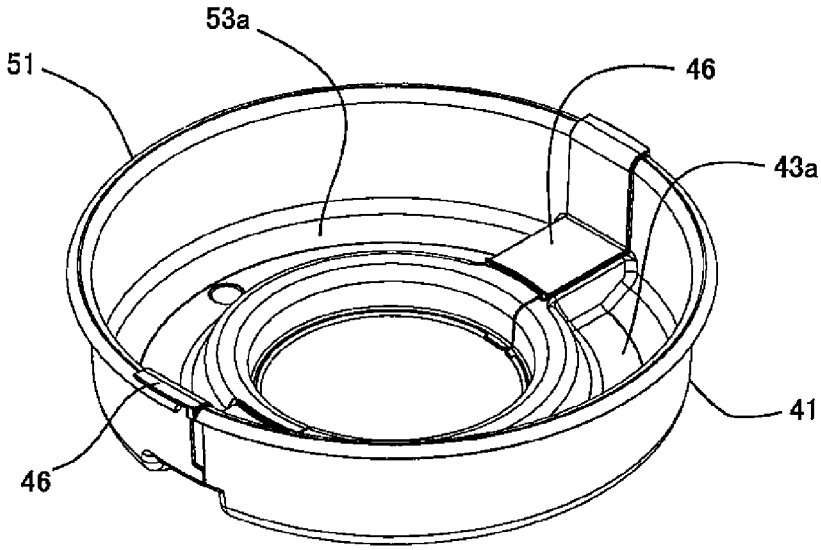
FIGS. 5A, 5B and 5C are top perspective, bottom perspective and partially enlarged views showing the first and second split dish members engaged with each other.
Figure 5B:
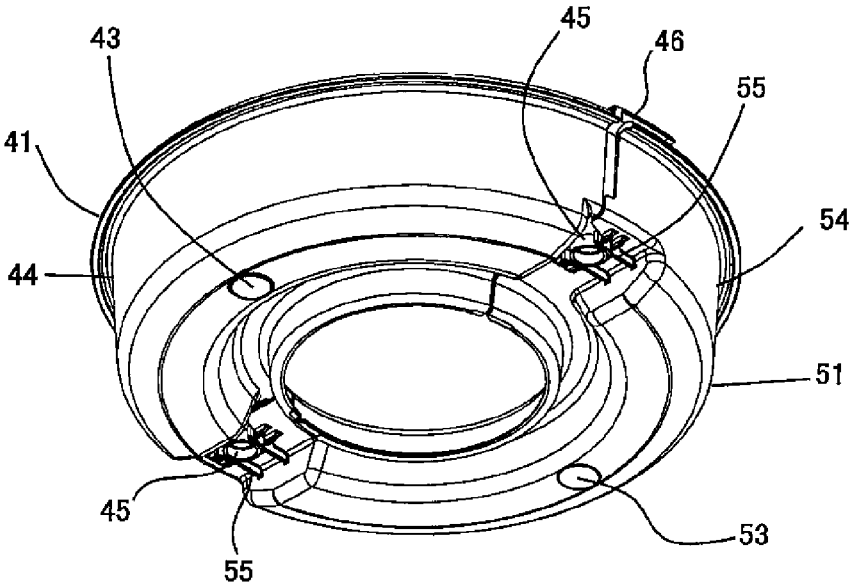
Figure 5C:
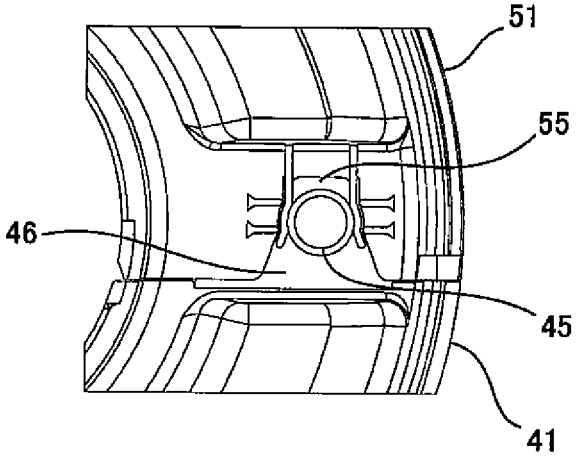

When reconnecting the first and second split dish members 41 and 51, they are first placed on the upper surface 7*d* of the support base 7 and arranged in a mutually opposing relationship as shown in FIGS. 4A through 4C. If the first and second split dish members 41 and 51 are moved toward each other in this state, the boss portions 45 come into engagement with the engagement portions 55 as shown in FIGS. 5A through 5C. Thus, the first and second split dish members 41 and 51 get connected so that they can collect clay. In the state that the boss portions 45 and the engagement portions 55 engage with each other, the overlapping portions 46 of the first split dish member 41 overlap with some areas of the upper surface and the wall portion 54 of the second split dish member 51. At this time, the joint areas of the first and second split dish members 41 and 51 are covered with the overlapping portions 46. Therefore, clay or water is hard to leak through the joint areas of the first and second split dish members 41 and 51 to the outside of the splash pan 4. In the state that the boss portions 45 engage with the engagement portions 55, the engagement portions 55 grip the circumferential surfaces of the cylindrical columnar boss portions 45 at the left and right sides thereof. The sections of the engagement portions 55 making contact with the boss portions 45 have a shape conforming to the circumferential surfaces of the boss portions 45. This makes it possible to securely couple the boss portions 45 and the engagement portions 55 together and to smoothly and easily separate the boss portions 45 and the engagement portions 55 by holding the respective opposite ends of the first and second split dish members 41 and 51.

In the pottery wheel 1 of the present preferred embodiment described above, the boss portions 45 on the outer surface (rear surface) of the first split dish member 41 engage with the engagement portions 55 on the outer surface (rear surface) of the second split dish member 51. Therefore, clay or water is hard to leak through the joint areas of the first and second split dish members 41 and 51 to the outside of the splash pan 4. Moreover, the boss portions 45 of the first split dish member 41 and the engagement portions 55 of the second split dish member 51 engage with each other through the elastic deformation of the engagement portions 55. Thanks to this feature, it is possible to reduce temporal wear of the boss portions 45 and the engagement portions 55, thereby preventing the coupling of the first and second split dish members 41 and 51 from being loosened. There is no possibility that the gap between the joint areas of the first and second split dish members 41 and 51 grows wide. This makes it difficult for clay or water to leak from the joint areas of the first and second split dish members 41 and 51 to the outside of the splash pan 4.

It should be understood that the preferred embodiment disclosed above is not limitative but illustrative in all respects. The scope of the present invention is not defined by the foregoing description but by the claims. All the changes or modifications equivalent to or falling within the claims are to be included in the scope of the present invention.

Next, description will be made on certain modified embodiments of the present invention.

(Modified Embodiments)

(a) While the splash pan 4 is formed of two split dish members, namely the first split dish member 41 and the second split dish member 51, in the present preferred embodiment, the present invention is not limited thereto. The splash pan 4 may be split into more than two dish members. For example, the splash pan 4 is split into more than two dish members of even number. In this case, the split dish members having boss portions formed on the outer surface thereof may be equal in number to the split dish members having engagement portions formed on the outer surface of the split dish member in the radial positions corresponding to the boss portions and opened toward the boss portions. The engagement portions of the split dish members having the engagement portions may engage with respective the boss portions of the split dish members having the boss portions through elastic deformation.

(b) In the present preferred embodiment, the boss portions 45 and the engagement portions 55 are provided on the outer surfaces (particularly, on the bottom outer surfaces) of the split dish members 41 and 51. The boss portions 45 are formed into a cylindrical columnar shape. The inner circumferential surfaces of the engagement portions 55 are shaped to be engageable with the boss portions 45. However, the present invention is not limited thereto. The shapes of the boss portions 45 and the engagement portions 55 are not particularly limited as long as the first and second split dish members 41 and 51 can be separated and connected through horizontal movement.

(c) In the present preferred embodiment, the first split dish member 41 is provided with the boss portions 45 at the opposite ends thereof and the second split dish member 51 is provided with the engagement portions 55 at the opposite ends thereof. However, the present invention is not limited thereto. Each of the split dish members 41 and 51 may be provided with the boss portion and the engagement portion at the opposite ends thereof.

(d) In the present preferred embodiment, the boss portions 45 are formed into a cylindrical columnar shape and are brought into engagement with the engagement portions 55 while allowing the left and right claws of the engagement portions 55 to grip the circumferential surfaces of the boss portions 45 at the left and right sides thereof. However, the present invention is not limited thereto. Each of the engagement portions may be formed of a single claw and each of the boss portions 45 may be brought into engagement with the corresponding engagement portion by allowing the single claw to press the circumferential surface of each of the boss portions. In this case, the boss portions and the engagement portions are engaged with each other by causing each of the claws of two engagement portions (formed at the circumferential ends of the bottom surfaces of the split dish members) to press the circumferential surface of the corresponding boss portion. This also makes it possible to securely couple the boss portions and the engagement portions together and to smoothly and easily separate the boss portions and the engagement portions by holding the opposite ends of the split dish members coupled together by the boss portions and the engagement portions. The engagement portions of the present preferred embodiment and the modified embodiment (d) may engage with other portions than the boss portions.

What is claimed is:

1. A splash pan of a pottery wheel to be arranged to cover bottom and side areas of a turntable, comprising:

a plurality of split dish members split in a circumferential direction and provided with a clay-storing concave portion, the split dish members being separably connectable to each other through substantially horizontal movement thereof, wherein the split dish members are two in number and include a first split dish member having boss portions formed on an outer bottom surface thereof and a second split dish member having engagement portions engageable with the boss portions, the engagement portions being formed on an outer bottom surface of the second split dish member in radial positions corresponding to the boss portions and opened toward the boss portions, the engagement portions of the second split dish member being elastically deformable when engaging with the boss portions of the first split dish member.

2. A splash pan of a pottery wheel to be arranged to cover bottom and side areas of a turntable, comprising:

a plurality of split dish members split in a circumferential direction and provided with a clay-storing concave portion, the split dish members being separably connectable to each other through substantially horizontal movement thereof, wherein the split dish members are even in number and include first split dish members each having boss portions formed on an outer bottom surface-thereof and second split dish members each having engagement portions engageable with the boss portions, the engagement portions being formed on an outer bottom surface of each of the second split dish members in radial positions corresponding to the boss portions and opened toward the boss portions, the first split dish members being equal in number to the second split dish members, the engagement portions of each of the second split dish members being elastically deformable when engaging with the boss portions of each of the first split dish members.

3. A splash pan of a pottery wheel to be arranged to cover bottom and side areas of a turntable, comprising:

a plurality of split dish members split in a circumferential direction and provided with a clay-storing concave portion, the split dish members being separably connectable to each other through horizontal movement thereof, wherein each of the split dish members includes a boss portion formed on an outer bottom surface of one end thereof and an engagement portion engageable with the boss portion formed on an outer bottom surface of the other end thereof, the engagement portions being elastically deformable when engaging with the boss portions.

4. The splash pan of claim 1, wherein the boss portions and the engagement portions are provided in circumferential end sections of the outer bottom surfaces of the split dish members, the boss portions extending downwards.

5. The splash pan of claim 2, wherein the boss portions and the engagement portions are provided in circumferential end sections of the outer bottom surfaces of the split dish members, the boss portions extending downwards.

6. The splash pan of claim 3, wherein the boss portions and the engagement portions are provided in circumferential end sections of the outer bottom surfaces of the split dish members, the boss portions extending downwards.

7. The splash pan of claim 1, wherein the boss portions has a cylindrical columnar shape, the engagement portions being engageable with the boss portions while gripping circumferential surfaces of the boss portions at left and right sides thereof.

8. The splash pan of claim 2, wherein the boss portions has a cylindrical columnar shape, the engagement portions being engageable with the boss portions while gripping circumferential surfaces of the boss portions at left and right sides thereof.

9. The splash pan of claim 3, wherein the boss portions has a cylindrical columnar shape, the engagement portions being engageable with the boss portions while gripping circumferential surfaces of the boss portions at left and right sides thereof.

10. The splash pan of claim 1, wherein the split dish member having the boss portions includes overlapping portions overlapping with an upper surface of the split dish member having the engagement portions when the boss portions engage with the engagement portions, the boss portions being formed in the overlapping portions.

11. The splash pan of claim 2, wherein the split dish member having the boss portions includes overlapping portions overlapping with an upper surface of the split dish member having the engagement portions when the boss portions engage with the engagement portions, the boss portions being formed in the overlapping portions.

12. The splash pan of claim 3, wherein the split dish member having the boss portions includes overlapping portions overlapping with an upper surface of the split dish member having the engagement portions when the boss portions engage with the engagement portions, the boss portions being formed in the overlapping portions.

13. A pottery wheel, comprising:

a turntable;

a motor arranged to rotationally drive the turntable;

a support base arranged to support the motor; and the splash pan of claim 1 attached to the support base.

14. A pottery wheel, comprising:

a turntable;

a motor arranged to rotationally drive the turntable;

a support base arranged to support the motor; and the splash pan of claim 2 attached to the support base.

15. A pottery wheel, comprising:

a turntable;

a motor arranged to rotationally drive the turntable;

a support base arranged to support the motor; and the splash pan of claim 3 attached to the support base.

* * * * *